US011127525B2

(12) United States Patent
Odahara et al.

(10) Patent No.: US 11,127,525 B2
(45) Date of Patent: Sep. 21, 2021

(54) COMPOSITE MAGNETIC MATERIAL AND COIL COMPONENT USING SAME

(71) Applicant: Murata Manufacturing Co., Ltd., Kyoto-fu (JP)

(72) Inventors: Mitsuru Odahara, Nagaokakyo (JP); Takuya Ishida, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 294 days.

(21) Appl. No.: 16/130,922

(22) Filed: Sep. 13, 2018

(65) Prior Publication Data

US 2019/0096566 A1 Mar. 28, 2019

(30) Foreign Application Priority Data

Sep. 22, 2017 (JP) ..... JP2017-182691

(51) Int. Cl.
*H01F 27/24* (2006.01)
*H01F 27/28* (2006.01)
(Continued)

(52) U.S. Cl.
CPC ..... *H01F 27/2847* (2013.01); *H01F 17/0013* (2013.01); *H01F 27/255* (2013.01);
(Continued)

(58) Field of Classification Search
CPC ..... H01F 27/2847; H01F 27/292; H01F 17/0013; H01F 27/2804; H01F 27/324;
(Continued)

(56) References Cited

U.S. PATENT DOCUMENTS 9,165,711 B2 * 10/2015 Lim ..... H01F 27/29
10,096,418 B2 10/2018 Arai et al.
(Continued)

FOREIGN PATENT DOCUMENTS

CN 104903009 A 9/2015
CN 107017081 A 8/2017
(Continued)

OTHER PUBLICATIONS

An Office Action; "Notification of Reasons for Refusal," mailed by the Korean Intellectual Property Office dated Oct. 4, 2019, which corresponds to Korean Patent Application No. 10-2018-0112347 and is related to U.S. Appl. No. 16/130,922; with English language translation.

*Primary Examiner* — Tuyen T Nguyen
(74) *Attorney, Agent, or Firm* — Studebaker & Brackett PC

(57) ABSTRACT

A composite magnetic material is provided that includes a resin and first magnetic particles provided inside the resin. Each of the first magnetic particles includes a first core comprising a metal magnetic material, and an insulating film that covers the first core. The first core has a substantially flat shape having a short axis and a long axis. A thickness of the insulating film in the long axis direction of the first core is smaller than a thickness of the insulating film in the short axis direction of the first core. In addition, a coil component is provided that includes the composite magnetic material in an element body of the coil component.

20 Claims, 8 Drawing Sheets

(51) Int. Cl.

| | |
|---|---|
| ***H01F 27/32*** | (2006.01) |
| ***H01F 27/255*** | (2006.01) |
| ***H01F 27/29*** | (2006.01) |
| ***H01F 17/00*** | (2006.01) |
| *H01F 17/04* | (2006.01) |

(52) U.S. Cl.
CPC ..... *H01F 27/2804* (2013.01); *H01F 27/292* (2013.01); *H01F 27/324* (2013.01); *H01F 2017/048* (2013.01); *H01F 2027/2809* (2013.01)

(58) Field of Classification Search
CPC ..... H01F 27/255; H01F 2017/048; H01F 2027/2809; H01F 1/26; H01F 27/24; H01F 27/306; H01F 41/02; H01F 1/24
See application file for complete search history.

(56) References Cited

U.S. PATENT DOCUMENTS

| | | | | |
|---|---|---|---|---|
| 10,147,540 | B2 * | 12/2018 | Tonoyama | H01F 41/04 |
| 10,546,680 | B2 * | 1/2020 | Park | H01F 17/0013 |
| 2006/0279395 | A1 * | 12/2006 | Lee | H01F 1/26 336/221 |
| 2009/0002117 | A1 | 1/2009 | Kawarai | |
| 2014/0097377 | A1 | 4/2014 | Igarashi | |
| 2015/0108392 | A1 | 4/2015 | Gotoh et al. | |
| 2015/0235753 | A1 * | 8/2015 | Chatani | H01F 27/255 336/200 |
| 2015/0352888 | A1 | 12/2015 | Schmid et al. | |
| 2016/0155550 | A1 | 6/2016 | Ohkubo et al. | |

FOREIGN PATENT DOCUMENTS

| | | | |
|---|---|---|---|
| JP | 2004-247663 | A | 9/2004 |
| JP | 2004-339598 | A | 12/2004 |
| JP | 2006-080166 | A | 3/2006 |
| JP | 2009-009985 | A | 1/2009 |
| JP | 2013-201375 | A | 10/2013 |
| JP | 2013-236021 | A | 11/2013 |
| JP | 2014-075511 | A | 4/2014 |
| JP | 2015-126200 | A | 7/2015 |
| JP | 2016-103598 | A | 6/2016 |
| JP | 2017-059592 | A | 3/2017 |

* cited by examiner

COMPOSITE MAGNETIC MATERIAL AND COIL COMPONENT USING SAME

CROSS-REFERENCE TO RELATED APPLICATION

This application claims benefit of priority to Japanese Patent Application No. 2017-182691, filed Sep. 22, 2017, the entire content of which is incorporated herein by reference.

BACKGROUND

Technical Field

The present disclosure relates to a composite magnetic material and a coil component.

Background Art

As a coil component of the related art, Japanese Unexamined Patent Application Publication No. 2013-201375 discloses a coil element that includes a coil part having a substrate and a flat coil conductor pattern provided on the substrate, a metal magnetic powder containing resin that is applied and formed so as to surround the coil part, a flat or needle shaped first metal magnetic powder that is included in the metal magnetic powder containing resin, and a second metal magnetic powder that is included in the metal magnetic powder containing resin and has a smaller average particle diameter than the first metal magnetic powder. Thus, a way of increasing magnetic permeability has been considered.

In the coil component of the related art, a higher withstand voltage performance is required as the coil component is further miniaturized. As a countermeasure to the effect of such miniaturization, a higher withstand voltage performance has been realized by increasing the film thickness of an insulating film of particles of a flat soft magnetic metal powder having an insulating film. However, it is clear that high magnetic permeability cannot be obtained when the insulating film thickness becomes large. On the other hand, when high magnetic permeability is realized in the coil element of the related art and the coil element is miniaturized, there is a risk that the withstand voltage property of the coil element will be inadequate.

SUMMARY

Accordingly, the present disclosure provides a composite magnetic material that has high magnetic permeability and can secure excellent withstand voltage performance, and to provide a coil component that includes the composite magnetic material.

The composite magnetic material according to a preferred embodiment of the present disclosure includes a resin and first magnetic particles provided inside the resin. The first magnetic particles each include a first core comprising a metal magnetic material, and an insulating film that covers the first core. The first core has a substantially flat shape having a short axis and a long axis. A thickness of the insulating film in a long axis direction of the first core is smaller than a thickness of the insulating film in a short axis direction of the first core.

The first cores of the first magnetic particles according to the preferred embodiment each have a substantially flat shape having a short axis and a long axis. The first cores are each covered by an insulating film. The thickness of the insulating film in the long axis direction of the first core is smaller than the thickness of the insulating film in the short axis direction of the first core. Thus, high magnetic permeability can be particularly obtained in the long axis direction of the first cores of the first magnetic particles.

Furthermore, since the thickness of the insulating film in the short axis direction of the first core can be increased, excellent withstand voltage performance can be particularly secured in the short axis direction of the first core of the magnetic particles. Therefore, both high magnetic permeability and excellent withstand voltage performance can be secured when the composite magnetic material including the first magnetic particles according to the preferred embodiment of the present disclosure is used.

In the composite magnetic material according to the preferred embodiment, the thickness of the insulating film in the long axis direction of the first core may be around 0-50 nm. According to this embodiment, excellent withstand voltage performance can be particularly secured in the insulating film in the short axis direction of the first core, and furthermore, high magnetic permeability can be particularly obtained in the long axis direction of the first core.

The composite magnetic material according to the preferred embodiment may further include second magnetic particles. The second magnetic particles may each include a second core, the second core may have a substantially flat shape having a short axis and a long axis, a length of the second core in a long axis direction of the second core may be smaller than a length of the first core in the long axis direction of the first core, and a length of the second core in a short axis direction of the second core may be smaller than a length of the first core in the short axis direction of the first core.

According to this embodiment, the packing ratio of the magnetic material in a coil component can be increased, and high magnetic permeability and excellent withstand voltage performance can be better secured. Thus, further miniaturization of a coil component can be facilitated, and high magnetic permeability and excellent withstand voltage performance can be realized.

In the composite magnetic material according to the preferred embodiment, an aspect ratio of the second core is around ¼-½ an aspect ratio of the first core. According to this embodiment, the packing ratio of magnetic particles can be increased by using magnetic particles having different aspect ratios. In addition, the flat particles of the magnetic material can be aligned in the same direction, and the magnetic permeability can be further increased.

The composite magnetic material according to the preferred embodiment may further include third magnetic particles. The third magnetic particles may each include a third core and be spherical, and an average particle diameter of the third cores may be smaller than the length of the first cores in the short axis direction of the first cores.

According to this embodiment, the magnetic permeability can be further increased. Furthermore, the packing ratio of the magnetic material in a coil component can be increased, and therefore high magnetic permeability and excellent withstand voltage performance can be better secured. Thus, for example, a coil component can be further miniaturized.

In the composite magnetic material according to the preferred embodiment, the average particle diameter of the third cores may be around 0.2-0.8 times the length of first cores in the short axis direction of the first cores of the first magnetic particles. According to this embodiment, dispersion of flat magnetic particles and spherical magnetic particles can be increased. Thus, for example, the packing ratio of the magnetic material in a coil component can be further increased, and high magnetic permeability and excellent withstand voltage performance can be better secured. In addition, a coil component can be further miniaturized.

A coil component according to preferred embodiment of the present disclosure includes an element body that includes the composite magnetic material; a coil that is provided inside the element body and is wound in a substantially spiral shape; and an outer electrode that is provided on the element body and is electrically connected to the coil. According to this embodiment, the element body formed of the composite magnetic material can secure both high magnetic permeability and excellent withstand voltage performance. In addition, when the element body according to this embodiment is used, further miniaturization of the coil component is possible while securing both high magnetic permeability and excellent withstand voltage performance.

In the coil component according to the preferred embodiment, the element body may include a first magnetic part that is arranged on one side of the coil in an axis direction of the coil and a second magnetic part that is arranged on another side of the coil in the axis direction of the coil. At least either of the first magnetic part and the second magnetic part may include the composite magnetic material, and the first magnetic particles may be arrayed such that the long axes of the first cores included in the composite magnetic material intersect the axis direction of the coil.

According to this embodiment, the thick parts of the insulating films of the first magnetic particles are arranged side by side between the outer electrode and the coil, and therefore the insulation resistance can be further increased and the withstand voltage performance can be increased. In addition, the thin parts of the insulating films of the first magnetic particles are arranged side by side in the direction in which the magnetic flux of the coil flows, and therefore excellent high magnetic permeability can be obtained. Therefore, the coil component can secure high magnetic permeability and excellent withstand voltage performance. In addition, further miniaturization of the coil component can be achieved while securing both these characteristics.

In the coil component according to the preferred embodiment, at least part of the outer electrode is located on an end surface, in the axis direction of the coil, of the magnetic part that includes the composite magnetic material. According to this embodiment, insulation resistance between the outer electrode and the coil can be further increased. In addition, the withstand voltage performance can be increased.

In the coil component according to the preferred embodiment, the magnetic part that includes the composite magnetic material may have a plurality of layers stacked in the axis direction of the coil, and the first magnetic particles may be included in a layer that is closest to the coil among the plurality of layers. According to this embodiment, insulation resistance between the outer electrode and the coil can be further increased. In addition, the withstand voltage performance can be increased. Furthermore, excellent high magnetic permeability can be obtained. Therefore, the coil component can secure high magnetic permeability and excellent withstand voltage performance. In addition, further miniaturization of the coil component can be achieved while securing both these characteristics.

In the coil component according to the preferred embodiment, the element body may include a third magnetic part that is arranged inside the coil, the third magnetic part may include the composite magnetic material, and the first magnetic particles included in the composite magnetic material may be arrayed such that the short axes of the first cores of the first magnetic particles intersect the axis direction of the coil. According to this embodiment, the long axes of the first magnetic particles are arranged side by side so as to extend along the direction in which magnetic flux flows through the inside of the coil, and therefore excellent high magnetic permeability can be obtained. Therefore, the coil component can realize higher magnetic permeability.

In the coil component according to the preferred embodiment, the coil may be an $\alpha$ wound coil or an edgewise wound coil. According to this embodiment, the coil component can more effectively obtain excellent high magnetic permeability utilizing the first magnetic particles.

According to the composite magnetic material of the preferred embodiment of the present disclosure, high magnetic permeability can be obtained, and furthermore, excellent withstand voltage performance can be secured. In addition, according to the coil component of the preferred embodiment of the present disclosure, both high magnetic permeability and excellent withstand voltage performance can be secured, and the coil component can be further miniaturized.

Other features, elements, characteristics and advantages of the present disclosure will become more apparent from the following detailed description of preferred embodiments of the present disclosure with reference to the attached drawings.

DETAILED DESCRIPTION

Hereafter, the present disclosure will be described in detail on the basis of illustrative embodiments.

First Embodiment

Figure 1:
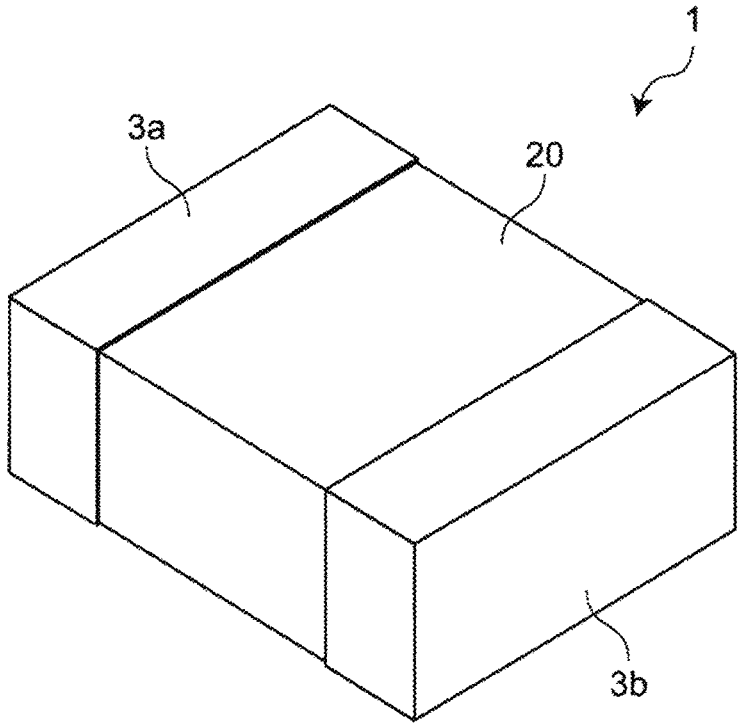
FIG. 1 is a perspective view illustrating a coil component of a first embodiment of the present disclosure.
Figure 2:
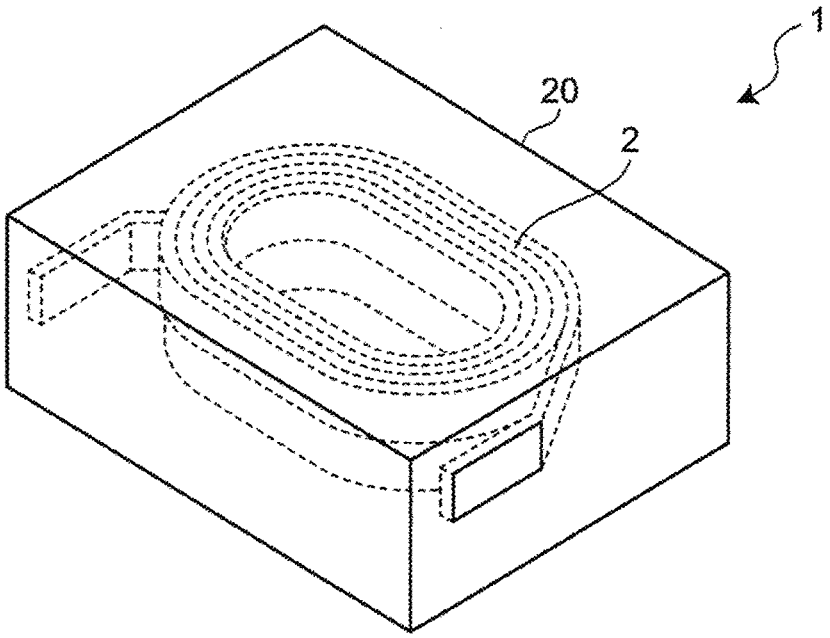
FIG. 2 is a schematic see-through perspective view of the coil component.
Figure 3:
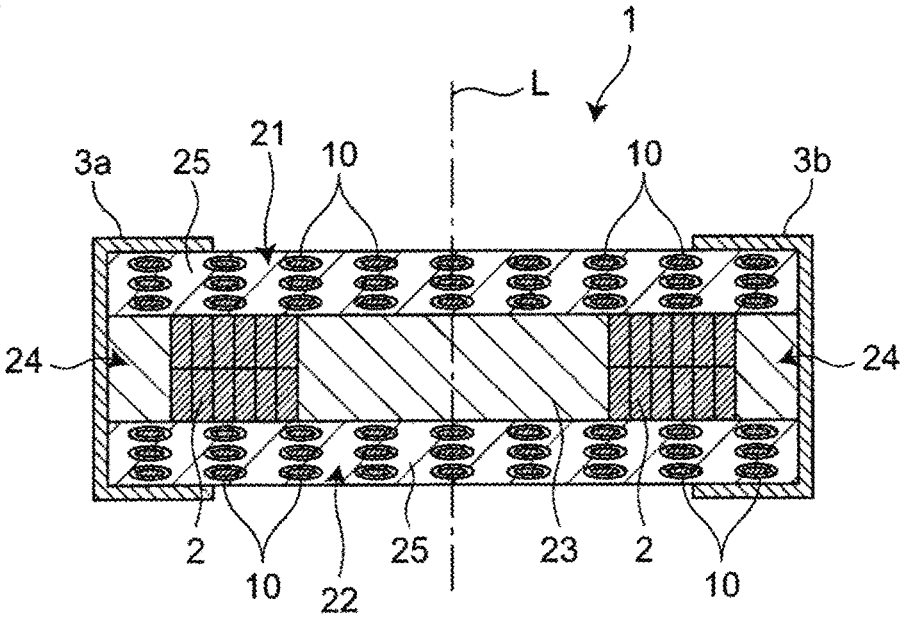
FIG. 3 is a schematic sectional view of the coil component.

FIG. 1 is a perspective view illustrating a coil component of a first embodiment of the present disclosure. FIG. 2 is a schematic see-through perspective view of the coil component. FIG. 3 is a schematic sectional view of the coil component of the first embodiment.

As illustrated in FIGS. 1, 2, and 3, a coil component 1 includes an element body 20 that includes a composite magnetic material including a resin 25 and first magnetic particles 10 that are provided inside the resin 25; a coil 2 that is provided inside the element body 20 and is wound in a substantially spiral shape; and outer electrodes 3*a* and 3*b* that are provided on the element body 20 and are electrically connected to the coil 2.

In the first embodiment, a first magnetic part 21 is arranged between the upper side of the coil 2 and the outer electrodes 3*a* and 3*b*, and a second magnetic part 22 is arranged between the lower side of the coil 2 and the outer electrodes 3*a* and 3*b*.

In addition, the coil component 1 has a third magnetic part 23 that is arranged inside the coil 2, and a fourth magnetic part 24 that is arranged outside the coil 2. The third magnetic part 23 and the fourth magnetic part 24 include the resin 25 and a granular powder (not illustrated). In the case where the third magnetic part and the fourth magnetic part do not include magnetic particles, the third magnetic part and the fourth magnetic part may also be referred to as non-magnetic parts.

In addition, the first magnetic particles 10 are illustrated in the drawings in a schematic manner for the purpose of explanation. Furthermore, the number and dimensions of the first magnetic particles 10 are appropriately selected in accordance with the required magnetic permeability, withstand voltage performance, size of the coil component, and so forth. In addition, as shown in FIG. 3, an axis (L) of the coil 2 refers to a center line of the spiral of the coil 2, and the axis (L) intersects end surfaces of the first magnetic part 21, the third magnetic part 23, and the second magnetic part 22.

The outer electrode 3*a* covers the entirety of the left surface of the element body 20, and covers part of each of the upper surface, the lower surface, the front surface, and the rear surface of the element body 20. The outer electrode 3*b* covers the entirety of the right surface of the element body 20, and covers part of each of the upper surface, the lower surface, the front surface, and the rear surface of the element body 20.

At least part of each outer electrode is located on an end surface, in the coil axis direction, of a magnetic part including the composite magnetic material. The insulation resistance and the withstand voltage performance can be increased by arranging the composite magnetic material between the outer electrodes and the coil.

In FIG. 3, the outer electrodes 3*a* and 3*b* are located on the end surfaces, in the coil axis direction, of the first magnetic part 21 and the second magnetic part 22. In addition, the outer electrodes 3*a* and 3*b* are illustrated as being substantially C shaped in FIG. 3, but at least one of the outer electrodes may instead be substantially L shaped.

In the first embodiment, the element body 20 includes a first magnetic part that is arranged on one side of the coil 2 in the coil axis direction and a second magnetic part that is arranged on the other side of the coil 2 in the coil axis direction. At least one magnetic part out of the first magnetic part and the second magnetic part includes the composite magnetic material, and the composite magnetic material includes the resin 25 and the first magnetic particles 10 provided inside the resin 25. In addition, the first magnetic particles 10 included in the composite magnetic material each have a first core 11 and a first insulating film 12 that covers the first core 11.

In this embodiment, as illustrated in FIG. 3, the first magnetic particles 10 are arrayed such that the long axes of the first cores intersect the coil axis (L) direction. Thus, the first magnetic particles 10 are adjacent to each other at the thin parts of the insulating films of the first magnetic particles 10, and as a result the magnetic permeability can be increased. In addition, in the case where outer electrodes are formed on the end surfaces in the coil axis direction, the thick parts of the insulating films of the magnetic particles 10 are arranged side by side between the outer electrodes and the coil, and as a result the withstand voltage performance of the coil component can be increased.

It is preferable for the magnetic parts that include the composite magnetic material to include a plurality of layers that are stacked in the coil axis (L) direction, and for the first magnetic particles 10 to be included in the layers located closest to the coil 2 among the plurality of layers. It is preferable for the first magnetic particles 10 to be arrayed such that the long axes of the first cores 11 thereof intersect the coil axis (L) direction.

The insulation resistance between the outer electrodes 3*a* and 3*b* and the coil can be further increased in this way. In addition, the withstand voltage performance can be increased. Furthermore, excellent high magnetic permeability can be obtained. Therefore, the coil component can secure high magnetic permeability and excellent withstand voltage performance. In addition, further miniaturization of the coil component can be achieved while securing both these characteristics. It is preferable that a magnetic part including the composite magnetic material, that is, at least one out of the first magnetic part 21 and the second magnetic part 22 in FIG. 3 have a plurality of layers stacked in the coil axis (L) direction.

Among the plurality of layers, the first magnetic particles 10 may be included in the layer that is closest to the coil 2. In this way, the insulation resistance between the outer electrodes and the coil 2 can be further increased. In addition, the withstand voltage performance can be increased.

In the first embodiment, the first magnetic particles 10 are arranged in the first magnetic part 21 and the second magnetic part 22.

Figure 4:
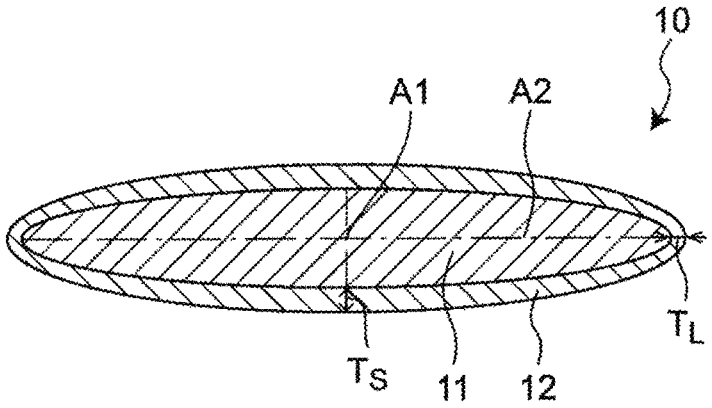
FIG. 4 is a sectional schematic view of a first magnetic particle.

FIG. 4 is a sectional schematic view of a first magnetic particle 10. The first magnetic particles 10 each include the first core 11, which is comprising a metal magnetic material, and the first insulating film 12, which covers the first core 11. The first core 11 has a substantially flat shape having a short axis (A1) and a long axis (A2). In addition, a thickness ($T_L$) of the first insulating film 12 in the long axis (A2) direction of the first core 11 is smaller than a thickness ($T_S$) of the first insulating film 12 in the short axis (A1) direction of the first core 11.

As a result of this relationship between the thickness of the first insulating film 12 in the long axis (A2) direction of the first core 11 and the thickness of the first insulating film 12 in the short axis (A1) direction of the first core 11, the withstand voltage performance of the coil component, that is, the withstand voltage performance between the coil 2 and the outer electrodes 3*a* and 3*b* can be secured when the composite magnetic material is arranged between the coil 2 and the outer electrodes 3*a* and 3*b* in the axis direction of the coil 2. Furthermore, the occurrence of abnormal plating spreading on the surfaces of the coil component 1 can be suppressed. In addition, shorts involving the coil 2 can be suppressed.

Figure 5:
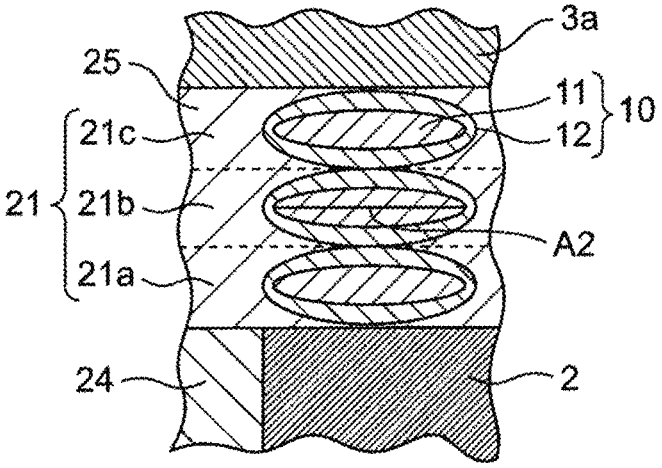
FIG. 5 is a schematic enlargement of FIG. 3.

FIG. 5 is a schematic enlargement of FIG. 3 in the first embodiment. The first magnetic particles 10 are arrayed such that the long axes (A2) of the first cores 11 of the first magnetic particles 10 intersect the axis (L) direction of the coil 2.

It is preferable that the angle formed between the long axis (A2) of the first core 11 of each first magnetic particle 10 and the axis (L) direction of the coil 2 be around 90°±10°, for example, 90°±5°. The inductance value is improved by arranging the first magnetic particles 10 so as to have this relationship.

In this case, the first magnetic part 21 is arranged between the outer electrode 3*a* and the coil 2, and the first magnetic part 21 includes a first magnetic layer 21*a*, a second magnetic layer 21*b*, and a third magnetic layer 21*c* stacked in the direction from the coil 2 side toward the outer electrode 3*a*. It is preferable that the first magnetic particles 10 be included in at least one layer out of the first magnetic layer 21*a*, the second magnetic layer 21*b*, and the third magnetic layer 21*c*.

For example, the first magnetic layer 21*a* includes the first magnetic particles 10. In addition, in the first embodiment, the first magnetic particles 10 are also included in the second magnetic layer 21*b* and the third magnetic layer 21*c*.

According to this embodiment, the insulation resistance between the outer electrode 3*a* and the coil 2 can be further increased, and the withstand voltage performance can be increased. Furthermore, excellent high magnetic permeability can be obtained. Therefore, both high magnetic permeability and excellent withstand voltage performance can be secured in the coil component, and additionally, further miniaturization of the coil component can be achieved.

Here, the boundary surfaces between the magnetic layers 21*a*, 21*b*, and 21*c* are illustrated as broken lines, but the first magnetic part 21 can be formed without substantial generation of boundary surfaces between the magnetic layers 21*a*, 21*b*, and 21*c* by appropriately selecting the resins included in the magnetic layers. It is preferable that the magnetic layers 21*a*, 21*b*, and 21*c* be formed using the same resin composition.

In the case where the first magnetic layer 21*a* includes the first magnetic particles 10, the thickness of the first magnetic layer 21*a* in the direction of the axis (L) of the coil 2 is preferably greater than or equal to ⅓ the distance between the coil 2 and the outer electrode 3*a*, that is, greater than or equal to around ⅓ the thickness of the first magnetic part 21. For example, the thickness of the first magnetic layer 21*a* in the direction of the axis (L) of the coil 2 is around ⅓-⅘ the thickness of the first magnetic part 21 arranged between the coil 2 and the outer electrode 3*a*.

Thus, the insulation resistance between the outer electrode 3*a* and the coil 2 can be further increased, and the withstand voltage performance can be increased. Furthermore, excellent high magnetic permeability can be obtained.

In the present specification, the number, arrangement, and so forth of the magnetic particles and so forth illustrated in the drawings have been simplified for the sake of explaining the present disclosure, and the number, arrangement, and so forth of the magnetic particles are not limited to the example illustrated in the drawings.

Hereafter, the constituent elements of the coil component 1 will be described in detail.

The element body 20 includes the composite magnetic material according to an embodiment of the present disclosure, and the composite magnetic material includes a resin. The resin is not particularly limited and for example, may be an epoxy resin, a phenol resin, a polyester resin, a polyimide resin, a polyolefin resin, or the like.

The first magnetic part 21 and the second magnetic part 22 may be formed of the same resin or may be formed of different resins. The same resin is preferably used.

In addition, the resins that are included in the third magnetic part 23 and the fourth magnetic part 24 may be the same as the resin included in at least one out of the first magnetic part 21 and the second magnetic part 22, or different resins may be used. The same resin is preferably used.

Hereafter, the first core will be described in detail.

The metal magnetic material forming the first core 11 is preferably a metal material that has soft magnetism. Examples of a metal material having soft magnetism include Fe, Fe—Ni alloys, Fe—Si—Al alloys, Fe—Si alloys, Fe—Co alloys, Fe—Cr alloys, Fe—Cr—Al alloys, Fe—Cr—Si alloys, various Fe-based amorphous alloys, and various Fe-based nano crystal alloys, for example.

The first core 11 has a substantially flat shape having a short axis (A1) and a long axis (A2), and the long-axis length of the first core 11 is preferably around 30-100 μm, and is around 40-90 μm, for example. Higher magnetic permeability can be obtained when the long-axis length lies within this kind of range. In addition, handling characteristics of the composite magnetic material such as the fluidity, strength, and so on of the composite magnetic material can be improved.

On the other hand, the short axis (A1) length of the first core 11 is preferably around 0.12-7 μm, and more preferably around 0.12-5 μm. The packing ratio of the magnetic material in the coil component can be increased when the short axis (A1) length of the first core 11 lies within this kind of range, and therefore high magnetic permeability and excellent withstand voltage performance can be better secured. Thus, further miniaturization of a power inductor such as the coil component can be achieved.

The first core 11 has an aspect ratio (long axis/short axis). This aspect ratio is around 15-250, for example, around 20-240.

The short axis (A1) direction length and the long axis (A2) direction length of the first core 11 can be measured using a known method. For example, the measurements can be made by observing the first core 11 using a scanning electron microscope (SEM) at a magnification of around ×1000-×50,000.

Then, the average lengths of these dimensions can be obtained by subjecting the obtained observation image to image analysis using image analysis software. For example, the short axis (A1) direction length and the long axis (A2) direction length of the first core 11 can be measured by obtaining an image and performing image analysis using "A Image Kun" (Registered Trademark), which is an integrated application of an IP-1000 PC manufactured by Asahi Kesei Engineering Corporation. In addition, the measurement is repeated a plurality of times, and the average values (N=20 for each measurement) of the measurements are taken as the short axis (A1) direction length and the long axis (A2) direction length of the first core 11.

The thickness ($T_S$) of the first insulating film 12 in the short axis (A1) direction of the first core 11 is preferably, for example, around 50-80 nm, for example, around 50-70 nm. Excellent withstand voltage performance can be secured in the short axis (A1) direction of the first core 11 of the first magnetic particle 10 when the thickness ($T_S$) of the first insulating film 12 in the short axis (A1) direction of the first core 11 lies within this kind of range.

The thickness ($T_L$) of the first insulating film 12 in the long axis (A2) direction of the first core 11 is preferably, for example, around 0-50 nm, for example, around 0.05-40 nm. A magnetic permeability μ' in the long axis direction of the first core 11 can be improved when the thickness ($T_L$) of the first insulating film 12 lies within this kind of range.

In the present disclosure, the thickness ($T_L$) of the first insulating film 12 in the long axis (A2) direction of the first core 11 is smaller than the thickness ($T_S$) of the first insulating film 12 in the short axis (A1) direction of the first core 11. In other words, in the first insulating film 12, a ratio between the long axis (A2) direction insulating film thickness and the short axis (A1) direction insulating film thickness (long axis (A2) direction insulating film thickness/short axis (A1) direction insulating film thickness) is less than 1. The insulating film thickness ratio of the first insulating film 12 is more preferably less than or equal to around ⅔. With this relationship, both higher magnetic permeability and excellent withstand voltage performance can be secured.

Here, measurement of the film thickness of the first insulating film 12 can be performed by embedding a first magnetic particle in resin and performing SEM observation on a cross section of the embedded first magnetic particle cut using ion milling, for example. The thickness ($T_S$) of the first insulating film 12 in the short axis (A1) direction of the first core 11 is measured at the thickest part of the first insulating film 12. The thickness ($T_L$) of the first insulating film 12 in the long axis (A2) direction of the first core 11 is obtained by measuring the film thickness at an end part of the first core 11.

The thickness ($T_S$) of the first insulating film 12 in the short axis (A1) direction of the first core 11 and the thickness ($T_L$) of the first insulating film 12 in the long axis (A2) of the first core 11 can be obtained by taking these measurements at the two locations on ten first magnetic particles 10 and then calculating the average values of these measurements.

Next, a method of forming the first insulating film 12 on the first core 11 will be described.

The method used to form the first insulating film 12 on the first core 11 can be chosen as appropriate. For example, a chemical conversion treatment, a sol gel method, a mechano-chemical method, or the like may be used.

Hereafter, a method of manufacturing the first magnetic particles 10 by forming the first insulating films 12 on the surfaces of the first cores 11 using a chemical conversion treatment will be exemplified.

A soft magnetism metal powder, which will form the first cores 11, is immersed in a phosphate treatment liquid, and stirring is performed for 60 minutes or more while maintaining a prescribed temperature of around 50-60° C. for example, and the first insulating films 12 of a required thickness is thus formed. Here, when the prescribed temperature is maintained, the phosphate treatment liquid reduces over time. After that, the first magnetic particles are made to rub against each other by increasing the rotation speed of the stirring, and as a result the parts of the insulating films adhered in the long axis direction (edge end portions of first magnetic particles) can be effectively scraped off, and the thickness ($T_L$) of the first insulating films 12 in the long axis (A2) direction of the first cores 11 can be controlled so as to be small. The rotational speed, which is to be changed, can be changed in accordance with a required film thickness difference, and is preferably increased to be greater than or equal to 20 rpm.

Manufacture of the first magnetic particles 10 can be completed by removing the first magnetic particles having first insulating films 12 of a desired thickness and drying the particles.

The first insulating films 12 are not limited to being formed using a method in which the first insulating films 12 are formed using a phosphate-based solution, and a silica-based solution may be used instead.

Next, the method of preparing the composite magnetic material will be described.

The method of preparing the composite magnetic material can be chosen as appropriate, and the composite magnetic material may be prepared by manufacturing a slurry by stirring and mixing together the first magnetic particles 10, a resin, and a solvent. The obtained slurry may be molded into a plate-like shape. In addition, the slurry may be molded into a sheet-like shape by using a comma coater or the like.

The orientations of the first magnetic particles 10 included in the composite magnetic material may be adjusted by molding the slurry inside a magnetic field, or by pressurizing the slurry at a prescribed pressure after the molding the slurry.

Next, a method of manufacturing the coil component 1 will be described.

For example, the coil component 1 can be manufactured using the manufacturing method disclosed in Japanese Unexamined Patent Application Publication No. 2015-126200 or Japanese Unexamined Patent Application Publication No. 2017-59592 using the composite magnetic material obtained as described above. The first magnetic part 21 and the second magnetic part 22 illustrated in FIG. 3 include the same type of resin and the first magnetic particles 10 provided inside the resin. The resin, the material of the first cores 11 of the first magnetic particles 10, the thickness of the first insulating films 12, and so forth may be changed in accordance with the intended purpose.

The rest of the configuration can be appropriately designed so as to satisfy the electrical characteristics required for the coil component such as the inductance value, direct-current resistance value, direct-current superimposition characteristics, and so forth.

The coil 2 is formed of a metal having a low resistance such as Cu, Ag, Au, or the like. It is preferable that a coil having a low resistance and a narrow pitch can be formed using Cu plating formed using a semi-additive method.

The coil 2 may be a coil formed by applying a paste in a coil pattern shape, may be a coil formed by winding a metal wire such as an α wound coil or an edgewise wound coil, or may be a coil formed by patterning a plating film into a coil shape using a photolithography method.

The coil 2 is preferably an α wound coil or an edgewise wound coil. The coil component 1 can more effectively exhibit excellent high magnetic permeability by utilizing the first magnetic particles 10 when the coil 2 is this type of coil.

The outer electrodes 3*a* and 3*b* are manufactured by fabricating base electrodes using a conductive paste having Ag as a main component, and then subjecting the base electrodes to Ni plating and Sn plating in this order, for example. The shapes and materials of the outer electrodes 3*a* and 3*b* are not limited to this example.

This coil component 1 is a common mode choke coil. The coil component 1 is mounted in an electronic appliance such as a personal computer, a DVD player, a digital camera, a TV, a cellular phone or an in-car electronic appliance, for example.

Second Embodiment

Figure 6:
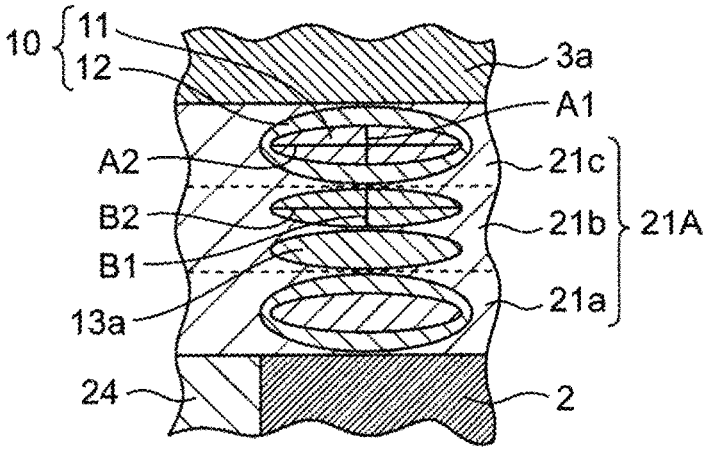
FIG. 6 is an enlarged schematic drawing in which part of a coil component of a second embodiment is enlarged.

FIG. 6 is an enlarged schematic drawing for explaining the arrangement of magnetic particles and illustrates an enlarged part of a coil component of a second embodiment.

In the second embodiment, a first magnetic part 21A included in an element body 20 includes resin and first magnetic particles 10 and second magnetic particles 13*a* provided inside the resin. Similarly, the same configuration can also be adopted for a second magnetic part 22 (not illustrated in FIG. 6).

In the second embodiment, the second magnetic particles 13*a* each have a second core but no insulating film. In this case, the second magnetic particles 13*a* corresponds to second cores. The second cores of the second magnetic particles 13*a* each have a substantially flat shape having a short axis (B1) and a long axis (B2).

The packing ratio of the magnetic material in the coil component can be made higher as a result of the second magnetic particles 13*a* not having insulating films. Thus, high magnetic permeability and excellent withstand voltage performance can be better secured. In addition, further miniaturization of a power inductor such as the coil component can be achieved while better securing high magnetic permeability and excellent withstand voltage performance.

Hereafter, the description will focus on points that are different from the first embodiment. The rest of the configuration is the same as in the first embodiment, and parts that are the same as in the first embodiment are denoted by the same symbols and description thereof is omitted.

In the second embodiment, the first magnetic part 21A is formed of a composite magnetic material that includes a resin and the first magnetic particles 10 and the second magnetic particles 13*a* provided inside the resin. According to this embodiment, the insulation resistance between the outer electrode 3*a* and the coil 2 can be further increased, and the withstand voltage performance can be increased. Furthermore, excellent high magnetic permeability can be obtained. Therefore, both high magnetic permeability and excellent withstand voltage performance can be secured in the coil component, and additionally, further miniaturization of the coil component can be achieved.

In the second embodiment, the first magnetic particles 10 are included in a first magnetic layer 21*a* and a third magnetic layer 21*c*. The details of the first magnetic particles 10 are as described above.

It is preferable that the second magnetic particles 13*a* have an aspect ratio that is on the same order as the aspect ratio of the first cores 11 of the first magnetic particles 10. The first magnetic part 21 may include spherical soft magnetism metal powder in addition to the first magnetic particles 10 and the second magnetic particles 13*a* depending on the required electrical characteristics and so on.

The second magnetic particles 13*a* may each have an insulating film. The magnetic permeability can be increased in this embodiment as well.

Third Embodiment

Figure 7:
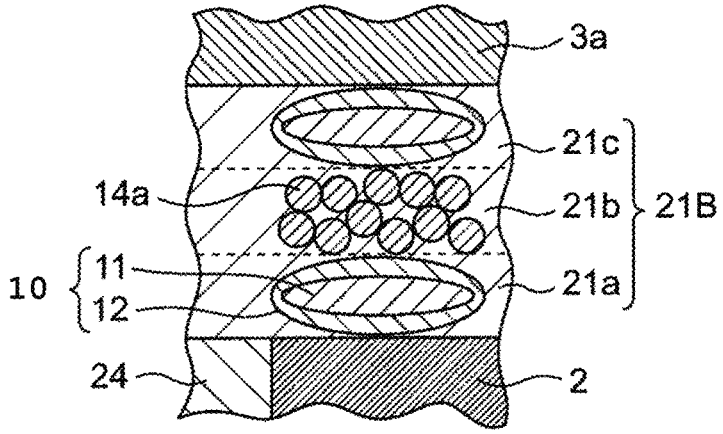
FIG. 7 is an enlarged schematic drawing in which part of a coil component of a third embodiment is enlarged.

FIG. 7 is an enlarged schematic drawing for explaining the arrangement of magnetic particles and illustrates an enlarged part of a coil component of a third embodiment. In the third embodiment, a first magnetic part 21B included in an element body 20 includes resin and first magnetic particles 10 and third magnetic particles 14*a* provided inside the resin. Similarly, the same configuration can also be adopted for a second magnetic part 22 (not illustrated in FIG. 7).

In other words, the substantially flat-shaped second magnetic particles 13*a* included in the second magnetic layer 21*b* in the second embodiment have been replaced with spherical third magnetic particles 14*a*.

Hereafter, the description will focus on points that are different from the first embodiment and the second embodiment. The rest of the configuration is the same as in the first embodiment and the second embodiment, and parts that are the same as in the first embodiment and the second embodiment are denoted by the same symbols and description thereof is omitted.

In the third embodiment, the third magnetic particles 14*a* each have a substantially spherical shape. The third magnetic particles 14*a* are preferably constituted by soft magnetism metal powder. In addition, the third magnetic particles 14*a* may have an insulating film if desired. Furthermore, the first magnetic particles 10 are preferably included in the layer that is closest to the coil.

It is preferable that the average particle diameter of the third magnetic particles 14*a* be around 0.5-1 times the short axis (A1) length of the first cores 11 of the first magnetic particles 10. When the average particle diameter of the third magnetic particles 14*a* lies within this range, the degree of close contact between the first magnetic particles 10 and the third magnetic particles 14*a* can be improved. Consequently, the withstand voltage performance can be improved and excellent high magnetic permeability can be obtained. Furthermore, the packing ratio of the magnetic material in the coil component can be increased, and therefore high magnetic permeability and excellent withstand voltage performance can be better secured. In addition, further miniaturization of a power inductor such as the coil component can be achieved while better securing high magnetic permeability and excellent withstand voltage performance.

The third magnetic particles 14*a* may be constituted by of a mixture of magnetic particles having at least two different average particle diameters. In this case, the average particle diameters of the cores of the plurality of magnetic particles included in the third magnetic particles 14*a* are appropriately selected from within a range of around 0.2-1.2 times the long axis (A2) length of the first cores 11 of the first magnetic particles 10.

The first magnetic particles 10 and the third magnetic particles 14*a* are able to closely contact each other and the degree of dispersion of the first magnetic particles 10 and the third magnetic particles 14*a* in the first magnetic part 21B can be increased when the average particle diameters of the cores of the at least two types of magnetic particles included in the third magnetic particles 14*a* lie within this kind of range. In this way, for example, the packing ratio of the magnetic material in the coil component can be increased, and both high magnetic permeability and excellent withstand voltage performance can be better secured. Further miniaturization of a power inductor such as the coil component can be achieved while securing both high magnetic permeability and excellent withstand voltage performance.

Fourth Embodiment

Figure 8:
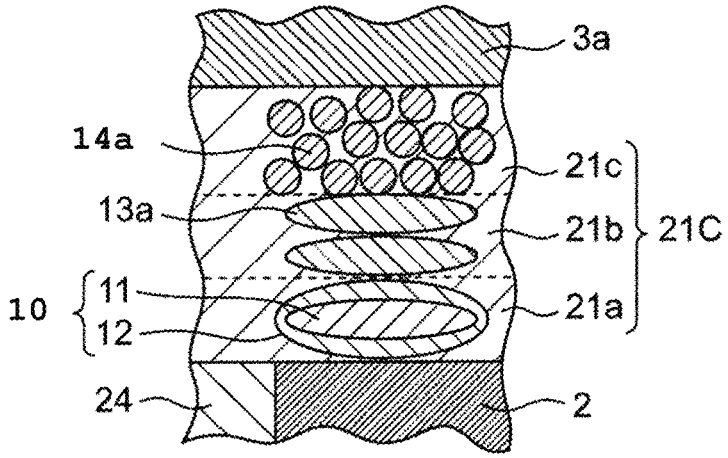
FIG. 8 is an enlarged schematic drawing in which part of a coil component of a fourth embodiment is enlarged.

FIG. 8 is an enlarged schematic drawing for explaining the arrangement of magnetic particles and illustrates an enlarged part of a coil component of a fourth embodiment. In the fourth embodiment, a first magnetic part 21C includes resin and first magnetic particles 10, second magnetic particles 13*a*, and third magnetic particles 14*a* provided inside the resin. Similarly, the same configuration can also be adopted for a second magnetic part 22 (not illustrated in FIG. 8).

Hereafter, the description will focus on points that are different from the first to third embodiments. The rest of the configuration is the same as in the first to third embodiments, and parts that are the same as in the first to third embodiments are denoted by the same symbols and description thereof is omitted.

In the fourth embodiment, the first magnetic part 21C includes the resin and the first magnetic particles 10, the second magnetic particles 13*a*, and the third magnetic particles 14*a* provided inside the resin. According to this embodiment, the insulation resistance between the outer electrode 3*a* and the coil 2 can be further increased, and the withstand voltage performance can be increased. In addition, the packing ratio of the magnetic material can be further increased, and therefore excellent high magnetic permeability can be obtained. Therefore, both high magnetic permeability and excellent withstand voltage performance can be secured in the coil component, and additionally, further miniaturization of the coil component can be achieved.

It is preferable that the first magnetic layer 21*a* include the first magnetic particles 10, that the second magnetic layer 21*b* include the second magnetic particles 13*a*, and that the third magnetic layer 21*c* include the third magnetic particles 14*a*. In addition, the arrangements of second magnetic particles 13*a* and the third magnetic particles 14*a* may be swapped, and in this case as well, it is preferable that the first magnetic particles 10 be included in the layer that is closest to the coil.

According to this embodiment, the packing ratio of the magnetic material in the coil component can be increased, and both high magnetic permeability and excellent withstand voltage performance can be better secured. In addition, further miniaturization of a power inductor such as the coil component can be achieved while securing both high magnetic permeability and excellent withstand voltage performance.

Details such as the shapes, materials, sizes, and so forth of the first magnetic particles 10, the second magnetic particles 13*a*, and the third magnetic particles 14*a* are the same as described above. At least either of the second magnetic particles 13*a* and the third magnetic particles 14*a* may each include an insulating film.

Fifth Embodiment

Figure 9:
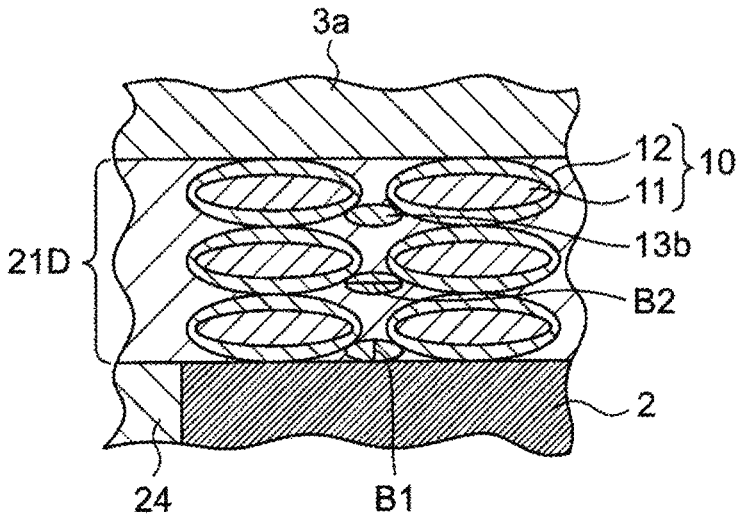
FIG. 9 is an enlarged schematic drawing in which part of a coil component of a fifth embodiment is enlarged.

FIG. 9 is an enlarged schematic drawing for explaining the arrangement of magnetic particles and illustrates an enlarged part of a coil component of a fifth embodiment. In the fifth embodiment, a first magnetic part 21D includes first magnetic particles 10 and second magnetic particles 13*b*. Similarly, the same configuration can also be adopted for a second magnetic part 22 (not illustrated in FIG. 9).

In the fifth embodiment, the second magnetic particles 13*b* each have a second core. In addition, in the case where the second magnetic particles 13*b* do not have an insulating film, the term second magnetic particles 13*b* means the second cores. The second cores of the second magnetic particles 13*b* each have a substantially flat shape having a short axis (B1) and a long axis (B2). The second magnetic particles 13*b* may each have an insulating film.

According to this embodiment, the magnetic permeability can be further increased.

In addition, the length of the second core in the short axis (B1) direction is smaller than the length of the first core 11 in the short axis (A1) direction, and/or the length of the second core in the long axis (B2) direction is smaller than the length of the first core 11 in the short axis (A1) direction. It is preferable that the length of the second core in the short axis (B1) direction be smaller than the length of the first core 11 in the short axis (A1) direction, and that the length of the second core in the long axis (B2) direction be smaller than the length of the first core 11 in the long axis (A2) direction. According to this embodiment, the magnetic permeability can be further increased.

In addition, the packing ratio of the magnetic material in the coil component can be increased, and both high magnetic permeability and excellent withstand voltage performance can be better secured. In addition, further miniaturization of a power inductor such as the coil component can be achieved while securing both high magnetic permeability and excellent withstand voltage performance.

Hereafter, the description will focus on points that are different from the first to fourth embodiments. The rest of the configuration is the same as in the first to fourth embodiments, and parts that are the same as in the first to fourth embodiments are denoted by the same symbols and description thereof is omitted.

Details such as the shape, material, size, and so forth of the first magnetic particles 10 are the same as described above.

The first magnetic particles 10 are arrayed such that the long axes (A2) of the first cores 11 of the first magnetic particles 10 intersect the coil axis (L) direction. In addition, the second magnetic particles 13*b* are arrayed such that the long axes (B2) of the second cores intersect the coil axis (L) direction. With the magnetic particles being arrayed in this manner, the parts where the insulating films are thick can be arranged side by side between the coil and the outer electrode, and the withstand voltage property can be increased. In addition, the magnetic permeability can be further increased.

It is preferable that the long axes (A2) of the first cores 11 of the first magnetic particles 10 and the long axes (B2) of the second cores of the second magnetic particles 13*b* be substantially parallel. High magnetic permeability can be better realized when the first magnetic particles 10 and the second magnetic particles 13*b* have this relationship with respect to the coil axis (L).

For example, the second magnetic particles 13*b* may each have an insulating film in order to prevent short circuits, and in this case, the size of the cores of the second magnetic particles 13*b* will satisfy the above conditions. The first magnetic part 21D may include spherical soft magnetism metal powder in addition to the second magnetic particles 13*b* if desired.

In this case, in the fifth embodiment, the length of the second cores of the second magnetic particles 13*b* the short axis (B1) direction is smaller than the length of the first cores 11 in the short axis (A1) direction, and/or the length of the second cores in the long axis (B2) direction is smaller than the length of the first cores 11 in the long axis (A2) direction. For example, the short axis (B1) direction length of the second cores of the second magnetic particles 13*b* may be around ⅓-⅔ the short axis (A1) direction length of the first cores 11 of the first magnetic particles 10.

The magnetic permeability can be further increased when the second magnetic particles 13*b* have this type of shape. In addition, dispersion of the first magnetic particles 10 and the second magnetic particles 13*b* can be increased. In this way, for example, the packing ratio of the magnetic material in the coil component can be increased, and both high magnetic permeability and excellent withstand voltage performance can be better secured. In addition, further miniaturization of a power inductor such as the coil component can be achieved.

In addition, the long axis (B2) direction length of the second cores of the second magnetic particles 13*b* may be around ⅓-⅔ the long axis (A2) direction length of the first cores 11 of first magnetic particles 10. In this way, for example, the packing ratio of the magnetic material in the coil component can be increased, and both high magnetic permeability and excellent withstand voltage performance can be better secured. In addition, further miniaturization of a power inductor such as the coil component can be achieved.

The above-described technical effects can be more effectively obtained in the case where the short axis (B1) direction length of the second cores of the second magnetic particles 13*b* is smaller than the short axis (A1) direction length of the first cores 11 and the long axis (B2) direction length of the second cores is smaller than the long axis (A2) direction length of the first cores 11.

Furthermore, the aspect ratio of the second magnetic particles 13*b* may be different from the aspect ratio of the first cores 11 of the first magnetic particles 10. The first magnetic particles 10 and the second magnetic particles 13*b* can be oriented in the same direction while increasing the packing ratio of the magnetic particles and the magnetic permeability can be improved by using magnetic particles having different aspect ratios.

The aspect ratio of the second magnetic particles 13*b* may be around 5-110, for example. In addition, the aspect ratio of the second cores of the second magnetic particles 13*b* is preferably around ¼-½ the aspect ratio of the first cores 11 of the first magnetic particles 10 (aspect ratio of second cores/aspect ratio of first cores).

Substantially flat magnetic particles can be oriented in the same direction while increasing the packing ratio of the magnetic particles and the magnetic permeability can be improved by including magnetic particles having different aspect ratios.

Here, in the fifth embodiment, the second magnetic particles 13*b* may be constituted by a soft magnetism metal powder, and may each have an insulating film. The insulating film of the second magnetic particles 13*b* may be the same as the first insulating film 12 of the first magnetic particles 10. Specifically, the cores of the second magnetic particles 13*b* may have a substantially flat shape having a short axis and a long axis, and a thickness ($T_{L2}$) of the insulating films of the second magnetic particles 13*b* in the long axis direction of the cores may be smaller than a thickness ($T_{S2}$) of the insulating film in the short axis direction of the cores.

The thickness ($T_{S2}$) of the insulating films of the second magnetic particles 13*b* in the short axis (B1) direction of the cores of the second magnetic particles 13*b* would be preferably, for example, around 50-80 nm, for example, around 50-70 nm.

Excellent withstand voltage performance can be secured in the short axis (B1) direction of the cores of the second magnetic particles 13*b* when the thickness ($T_{S2}$) of the insulating film in the short axis (B1) direction of the cores of the second magnetic particles 13*b* lies within this kind of range.

The thickness ($T_{L2}$) of the insulating films of the second magnetic particles 13*b* in the long axis (B2) direction of the cores is preferably, for example, around 0-50 nm, for example, around 0.05-40 nm. The magnetic permeability μ' in the long axis direction of the second cores of the second magnetic particles 13*b* can be improved when the thickness ($T_{L2}$) of the insulating film in the long axis (B2) direction of the cores lies within this kind of range.

The ratio of the long axis (B2) direction insulating film thickness/short axis (B1) direction insulating film thickness for the insulating films of the second magnetic particles 13*b* is less than 1, more preferably less than or equal to ⅔. With this relationship, both higher magnetic permeability and excellent withstand voltage performance can be secured. The thickness ($T_{L2}$) of the insulating films of the second magnetic particles 13*b* in the long axis (B2) direction of the cores is smaller than the thickness ($T_{S2}$) of the insulating films in the short axis (B1) direction of the cores.

Sixth Embodiment

Figure 10:
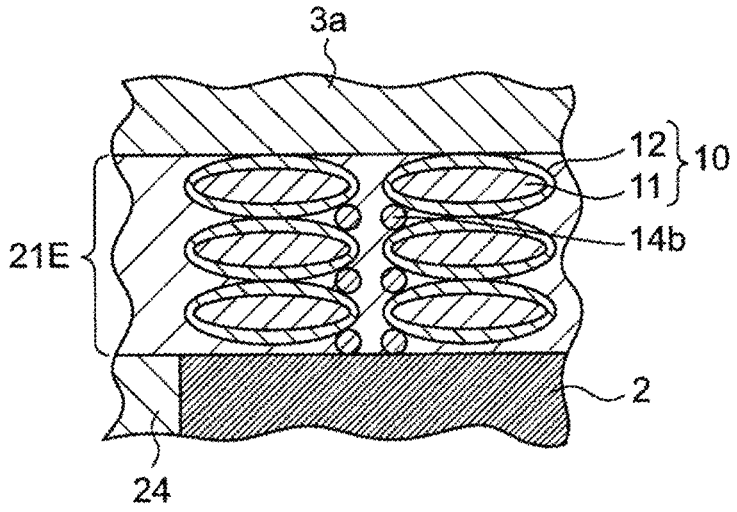
FIG. 10 is an enlarged schematic drawing in which part of a coil component of a sixth embodiment is enlarged.

FIG. 10 is an enlarged schematic drawing for explaining the arrangement of magnetic particles and illustrates an enlarged part of a coil component of a sixth embodiment. In the sixth embodiment, a first magnetic part 21E includes first magnetic particles 10 and third magnetic particles 14*b*. Similarly, the same configuration can also be adopted for a second magnetic part 22 (not illustrated in FIG. 10).

In the sixth embodiment, the third magnetic particles 14*b* each have a third core. In a case where the third magnetic particles 14*b* do not have an insulating film, the terms third magnetic particles 14*b* and third cores have the same meaning.

According to this embodiment, the magnetic permeability can be further increased.

Hereafter, the description will focus on points that are different from the first to fifth embodiments. The rest of the configuration is the same as in the first to fifth embodiments, and parts that are the same as in the first to fifth embodiments are denoted by the same symbols and description thereof is omitted.

In the sixth embodiment, details such as the shape, material, size, and so forth of the first magnetic particles 10 are the same as described above.

The third magnetic particles 14*b* are spherical and each have a third core, and the average particle diameter of the third cores is smaller than the short axis (A1) direction length of the first cores 11. Thus, dispersion of the first magnetic particles 10 and the spherical third magnetic particles 14*b* can be increased. In addition, for example, the packing ratio of the magnetic material in the coil component can be further increased, and a higher magnetic permeability can be facilitated. Furthermore, excellent withstand voltage performance can be secured. In addition to high magnetic permeability, further miniaturization of a power inductor such as a coil component can be facilitated while securing excellent withstand voltage performance.

The third magnetic particles 14*b* are preferably constituted by a soft magnetism metal powder. In addition, the third magnetic particles 14*b* preferably each have an insulating film in order to prevent short circuits.

It is preferable that the average particle diameter of the third magnetic particles 14*b* be around 0.2-0.8 times the short axis (A1) direction length of the first cores 11 of the first magnetic particles. In this way, dispersion of the first magnetic particles 10 and the spherical third magnetic particles 14*b* can be increased, and for example, the packing ratio of the magnetic material in the coil component can be further increased. In addition, high magnetic permeability and excellent withstand voltage performance can be better secured. In addition, further miniaturization of a power inductor such as a coil component can be facilitated while securing high magnetic permeability and excellent withstand voltage performance.

The third magnetic particles 14*b* may be constituted by a mixture of magnetic particles having at least two different average particle diameters. For example, the third magnetic particles 14*b* include magnetic particles that have peak values of at least two average particle diameters from within a range of around 0.2-0.8 times the short axis (A1) length of the first cores of the first magnetic particles 10. When the average particle diameters of at least two different types of magnetic particles 14*c* lie within this kind of range, the first magnetic particles 10 and the third magnetic particles 14*b* having different average particle diameters can closely contact each other, and dispersion of the first magnetic particles 10 and the third magnetic particles 14*b* in the element body 20 can be increased. In this way, for example, the packing ratio of the magnetic material in the coil component 1 can be increased, and both high magnetic permeability and excellent withstand voltage performance can be better secured. In addition, further miniaturization of a power inductor such as the coil component 1 can be facilitated.

Seventh Embodiment

Figure 11:
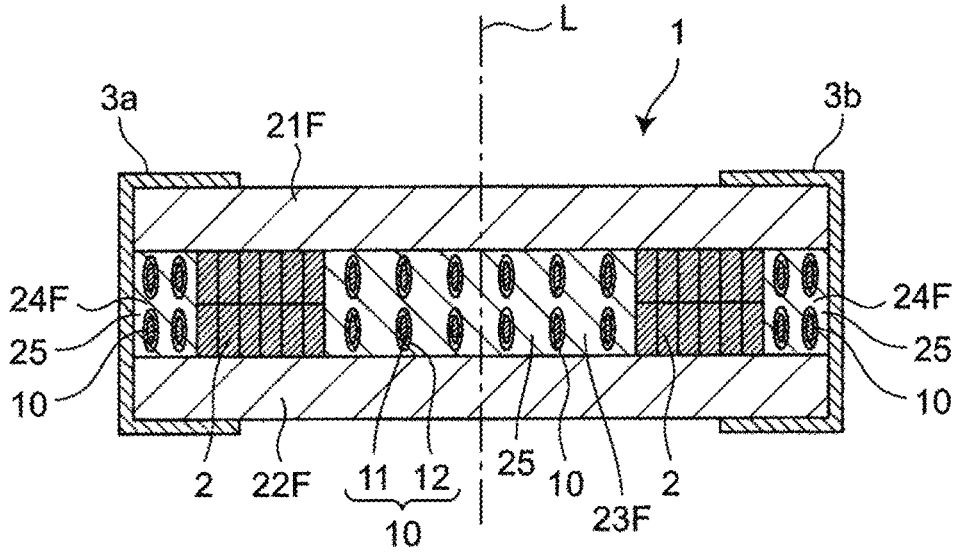
FIG. 11 is a schematic sectional view of a coil component of a seventh embodiment.

FIG. 11 is a schematic sectional view of a coil component of a seventh embodiment.

In a coil component 1 according to the seventh embodiment, the element body 20 has a third magnetic part 23F, which is arranged inside the coil, the third magnetic part 23F includes the composite magnetic material, and the first magnetic particles 10 included in the composite magnetic material are arrayed such that the short axes (A1) of the first cores 11 of the first magnetic particles 10 intersect the coil axis (L) direction.

Hereafter, the description will focus on points that are different from the first embodiment. The rest of the configuration is the same as in the first embodiment, and parts that are the same as in the first embodiment are denoted by the same symbols and description thereof is omitted.

In the seventh embodiment, first magnetic particles 10 having the form exemplified in FIG. 4 are arranged in the third magnetic part 23F.

In addition, as illustrated in FIG. 11, the first magnetic particles 10 may also be arranged in a fourth magnetic part 24F, and in this case as well, the first magnetic particles 10 can be arrayed such that the short axes (A1) of the first cores 11 of the first magnetic particles 10 intersect the coil axis (L) direction. The angle between the short axes (A1) of the first cores and the direction of the axis (L) of the coil 2 is preferably around 90°±10°, for example, around 90°±5°.

In this way, the insulation resistance between the outer electrodes and the coil can be further increased. In addition, the withstand voltage performance can be increased. Furthermore, excellent high magnetic permeability can be obtained. Therefore, the coil component can secure high magnetic permeability and excellent withstand voltage performance. In addition, further miniaturization of the coil component can be achieved while securing both these characteristics.

In addition, at least either of the third magnetic part 23F and the fourth magnetic part 24F may include at least either of the second magnetic particles and the third magnetic particles described above. For example, the packing ratio of the magnetic material in the coil component can be increased in this way. In addition, high magnetic permeability and excellent withstand voltage performance can be better secured.

A first magnetic part 21F and a second magnetic part 22F at least include the resin, and may include granular powder (not illustrated) if desired. As the granular powder, a known granular powder can be selected so long as the selected granular powder does not impair the technical effects of this embodiment, and the granular powder can be appropriately selected so as to satisfy the electrical characteristics required for the coil component (inductance value, direct-current resistance value, direct-current superimposition characteristics, and so forth).

EXAMPLE

Next, an example of the first embodiment will be described.

Manufacture of First Magnetic Particles

A chemical conversion treatment was performed in which a flat-particle Fe—Si—Cr powder was immersed in a phosphate treatment liquid and stirring was performed for 65 minutes at 55° C. Through this treatment, an insulating film was formed on the surfaces of the flat particles constituting the soft magnetism metal powder.

In the chemical conversion treatment, the thickness of the insulating films formed in the long axis direction of the cores was adjusted by causing the parts of the insulating films formed in the long axis direction of the cores (edge ends of flat metal powder particles) out of the insulating films formed on the flat metal powder particles, that is, the cores of the first magnetic particles to be scrapped off by increasing the stirring speed in accordance with the required film thickness.

Next, manufacture of the first magnetic particles was completed by drying the obtained flat particles. The film thickness of the obtained first magnetic particles was measured in the following way.

A first magnetic particle was embedded in resin and SEM observation was performed on a cross section of the embedded first magnetic particle cut by ion milling carried out using an SU-8040 manufactured by Hitachi High-Technologies Corporation.

Figure 12A:
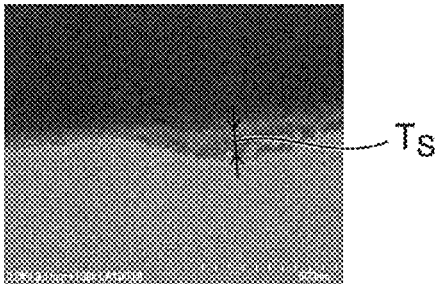
FIG. 12A illustrates an SEM observation image of an insulating film thickness of a first magnetic particle in a short axis direction.

For the parts listed below, an SEM image with a magnification of ×100,000 was obtained and the maximum value of the film thickness within the image was taken to be the insulating film thickness of each part. FIG. 12A illustrates an SEM observation image of the insulating film thickness of a first magnetic particle in a short axis direction. The insulating film thickness in the short axis direction of the core was measured as 121 nm.

Figure 12B:
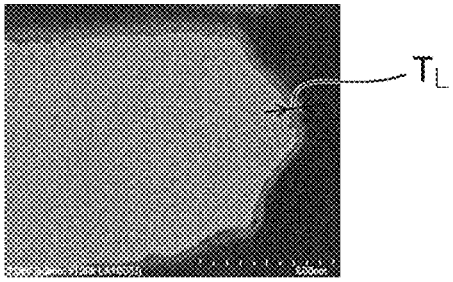
FIG. 12B illustrates an SEM observation image of an insulating film thickness of a first magnetic particle in a long axis direction.

In addition, FIG. 12B illustrates an SEM observation image of an insulating film thickness of a first magnetic particle in a long axis direction. The insulating film thickness in the long axis direction of the core was measured as 37 nm.

In the above-described method, data for 10 particles×two locations (n=20) was acquired for the first magnetic particles, and average values obtained from the data were taken to be film thicknesses of the first magnetic particles. In this example, the insulating film thickness in the short axis direction of the core was 65 nm. The insulating film thickness in the long axis direction of the core was 40 nm.

Manufacture of Composite Magnetic Material

Figure 13:
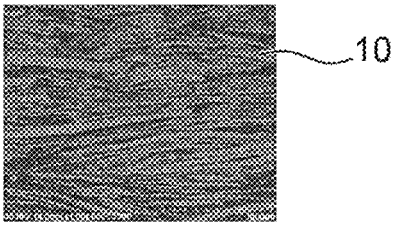
FIG. 13 illustrates an SEM observation image illustrating the orientation of first magnetic particles included in a composite magnetic material.

A slurry was manufactured by stirring and mixing together the first magnetic particles manufactured as described above, an epoxy resin, and a solvent. The slurry was molded into a plate-like shape. The first magnetic particles were oriented when the slurry was molded on a plate. FIG. 13 illustrates an SEM observation image illustrating the orientations of the first magnetic particles included in the composite magnetic material. In FIG. 13, flat portions illustrated in an outlined manner are the first magnetic particles.

Manufacture of Coil Component

A coil component was manufactured by manufacturing the coil component illustrated in the schematic sectional view of FIG. 3 in accordance with the manufacturing methods disclosed in Japanese Unexamined Patent Application Publication No. 2015-126200 and Japanese Unexamined Patent Application Publication No. 2017-59592.

The composite magnetic material obtained as described above was included in the first magnetic part 21 and the second magnetic part 22 illustrated in FIG. 3. The magnetic permeability μ' (1 MHz) of the first magnetic part 21 and the second magnetic part 22 was 45.

An element body center part of the element body 20 included a magnetic material in which spherical Fe-based amorphous alloy powder particles having D50 particle diameters of 35 μm and 5 μm and on which an insulating film was formed were mixed at a weight ratio of 75:25. The magnetic permeability μ' (1 MHz) of the element body center part was 30.

According to the above-described example, both high magnetic permeability and excellent withstand voltage performance could be secured.

The present disclosure is not limited to the above-described embodiments and design changes can be made within a range that does not depart from the gist of the present disclosure. For example, the characteristic features of the first to seventh embodiments may be combined with each other in various ways.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A composite magnetic material comprising:

a resin; and first magnetic particles provided inside the resin;

wherein each of the first magnetic particles includes a first core comprising a metal magnetic material, and an insulating film that entirely covers the first core, the first core has a substantially flat shape having a short axis extending at a midpoint of the first core and a long axis perpendicular to the short axis, and a thickness of the insulating film in a long axis direction of the first core is smaller than a thickness of the insulating film in a short axis direction of the first core.

2. The composite magnetic material according to claim 1, wherein the thickness of the insulating film in the long axis direction of the first core is around 0.05 nm-50 nm.

3. The composite magnetic material according to claim 1, further comprising:

second magnetic particles;

wherein each of the second magnetic particles includes a second core, the second core has a substantially flat shape having a short axis and a long axis, a length of the second core in a long axis direction of the second core is smaller than a length of the first core in the long axis direction of the first core, and a length of the second core in a short axis direction of the second core is smaller than a length of the first core in the short axis direction of the first core.

4. The composite magnetic material according to claim 3, wherein an aspect ratio of the second core is around ¼-½ an aspect ratio of the first core.

5. The composite magnetic material according to claim 1, further comprising:

third magnetic particles;

wherein each of the third magnetic particles includes a third core and are spherical, and an average particle diameter of the third cores is smaller than the length of the first cores in the short axis direction of the first cores.

6. The composite magnetic material according to claim 5, wherein the average particle diameter of the third cores is around 0.2-0.8 times the length of the first cores in the short axis direction of the first cores.

7. A coil component comprising:

an element body that includes the composite magnetic material according to claim 1;

a coil that is provided inside the element body and is wound in a substantially spiral shape; and an outer electrode that is provided on the element body and is electrically connected to the coil.

8. The coil component according to claim 7, wherein the element body includes a first magnetic part that is arranged on one side of the coil in an axis direction of the coil, and a second magnetic part that is arranged on another side of the coil in the axis direction of the coil, at least one of the first magnetic part and the second magnetic part includes the composite magnetic material, and the first magnetic particles are arrayed such that the long axes of the first cores included in the composite magnetic material intersect the axis direction of the coil.

9. The coil component according to claim 8, wherein at least part of the outer electrode is located on an end surface, in the axis direction of the coil, of the magnetic part that includes the composite magnetic material.

10. The coil component according to claim 7, wherein the magnetic part that includes the composite magnetic material has a plurality of layers stacked in the axis direction of the coil, and the first magnetic particles are included in a layer that is closest to the coil among the plurality of layers.

11. The coil component according to claim 7, wherein the element body includes a third magnetic part that is arranged inside the coil, the third magnetic part includes the composite magnetic material, and the first magnetic particles included in the composite magnetic material are arrayed such that the short axes of the first cores of the first magnetic particles intersect the axis direction of the coil.

12. The coil component according to claim 7, wherein the coil is an α wound coil or an edgewise wound coil.

13. The composite magnetic material according to claim 2, further comprising:

second magnetic particles;

wherein each of the second magnetic particles includes a second core, the second core has a substantially flat shape having a short axis and a long axis, a length of the second core in a long axis direction of the second core is smaller than a length of the first core in the long axis direction of the first core, and a length of the second core in a short axis direction of the second core is smaller than a length of the first core in the short axis direction of the first core.

14. The composite magnetic material according to claim 2, further comprising:

third magnetic particles;

wherein each of the third magnetic particles includes a third core and are spherical, and an average particle diameter of the third cores is smaller than the length of the first cores in the short axis direction of the first cores.

15. The composite magnetic material according to claim 3, further comprising:

third magnetic particles;

wherein each of the third magnetic particles includes a third core and are spherical, and an average particle diameter of the third cores is smaller than the length of the first cores in the short axis direction of the first cores.

16. A coil component comprising:

an element body that includes the composite magnetic material according to claim 2;

a coil that is provided inside the element body and is wound in a substantially spiral shape; and an outer electrode that is provided on the element body and is electrically connected to the coil.

17. A coil component comprising:

an element body that includes the composite magnetic material according to claim 3;

a coil that is provided inside the element body and is wound in a substantially spiral shape; and an outer electrode that is provided on the element body and is electrically connected to the coil.

18. The coil component according to claim 8, wherein the magnetic part that includes the composite magnetic material has a plurality of layers stacked in the axis direction of the coil, and the first magnetic particles are included in a layer that is closest to the coil among the plurality of layers.

19. The coil component according to claim 9, wherein the magnetic part that includes the composite magnetic material has a plurality of layers stacked in the axis direction of the coil, and the first magnetic particles are included in a layer that is closest to the coil among the plurality of layers.

20. The coil component according to claim 8, wherein the coil is an $\alpha$ wound coil or an edgewise wound coil.

* * * * *